US006074005A

United States Patent [19]

Simmons

[11] Patent Number: 6,074,005

[45] **Date of Patent: *Jun. 13, 2000**

[54] BUS STOP SEATING DEVICE

[76] Inventor: Charles R. Simmons, 555 Cherry Dr., Eugene, Oreg. 97401

[ * ] Notice: This patent issued on a continued prosecution application filed under 37 CFR 1.53(d), and is subject to the twenty year patent term provisions of 35 U.S.C. 154(a)(2).

[21] Appl. No.: 09/104,858

[22] Filed: Jun. 24, 1998

Related U.S. Application Data

[60] Provisional application No. 60/051,061, Jun. 27, 1997.

[51] Int. Cl.[7] ..... A47C 9/00; A47C 31/00

[52] U.S. Cl. ..... 297/217.1; 297/451.5; 248/519; 108/150

[58] Field of Search ..... 297/451.4, 451.5, 297/232, 248, 217.1; 248/519, 530, 156; 108/150, 64, 59, 151; 52/297

[56] References Cited

U.S. PATENT DOCUMENTS

| | | | |
|---|---|---|---|
| 2,520,450 | 8/1950 | Austin | 108/150 |
| 2,714,420 | 8/1955 | Scout . | |
| 2,883,247 | 4/1959 | Thompson . | |
| 3,000,512 | 9/1961 | Maynor | 312/108 |
| 3,606,222 | 9/1971 | Howard . | |
| 3,620,174 | 11/1971 | Dentino | 108/151 |
| 3,638,802 | 2/1972 | Westerfield . | |
| 3,870,363 | 3/1975 | Barecki | 297/451.4 |
| 3,910,631 | 10/1975 | Inaba . | |
| 3,920,295 | 11/1975 | Speckin | 312/108 |
| 4,070,837 | 1/1978 | Sato | 52/297 |
| 4,383,487 | 5/1983 | Fitzner et al. | 108/150 |
| 5,143,108 | 9/1992 | Kenney . | |
| 5,470,038 | 11/1995 | Clark | 248/530 |
| 5,479,880 | 1/1996 | Stuhr et al. | 248/156 |
| 5,722,721 | 3/1998 | Batoff et al. | 297/451.5 |

*Primary Examiner*—Anthony D. Barfield

*Attorney, Agent, or Firm*—Kolisch, Hartwell, Dickinson, McCormack & Heuser

[57] ABSTRACT

The invention provides a bus stop seating device including a tube dimensioned to encompass a sign post. A pair of rigid seats are connected to the tube on opposite sides of the tube.

14 Claims, 3 Drawing Sheets

BUS STOP SEATING DEVICE

CROSS REFERENCE TO RELATED APPLICATION

This application incorporates by reference U.S. Provisional Patent Application Ser. No. 60/051,061, filed Jun. 27, 1997 of inventor Charles Simmons.

FIELD OF THE INVENTION

The invention relates to seating devices, particularly for use in conjunction with a sign post.

BACKGROUND OF THE INVENTION

Every day millions of people rely on buses for transportation. Those who ride buses typically need to wait at designated bus stops. It is often desirable to sit at the bus stop while waiting for a bus to arrive. Exceptionally busy bus stops may justify elaborate shelters or seating accommodations. However, it is not feasible or cost effective to provide elaborate seating accommodations at many bus stops. Therefore, most bus stops have only a sign to mark the stop and no available seating.

SUMMARY OF THE INVENTION

The invention provides a seating device that is simple and cost effective to use at bus stops in conjunction with a typical sign post. The seating device includes a rigid tube that is dimensioned to encompass a sign post. A pair of rigid seat structures are connected to the tube, thereby defining two seating surfaces that are approximately perpendicular to the tube and located on opposite sides of the tube. An anchoring mechanism is connected to a lower end of the tube for fastening the tube to the ground.

DESCRIPTION OF THE INVENTION

Figure 1:
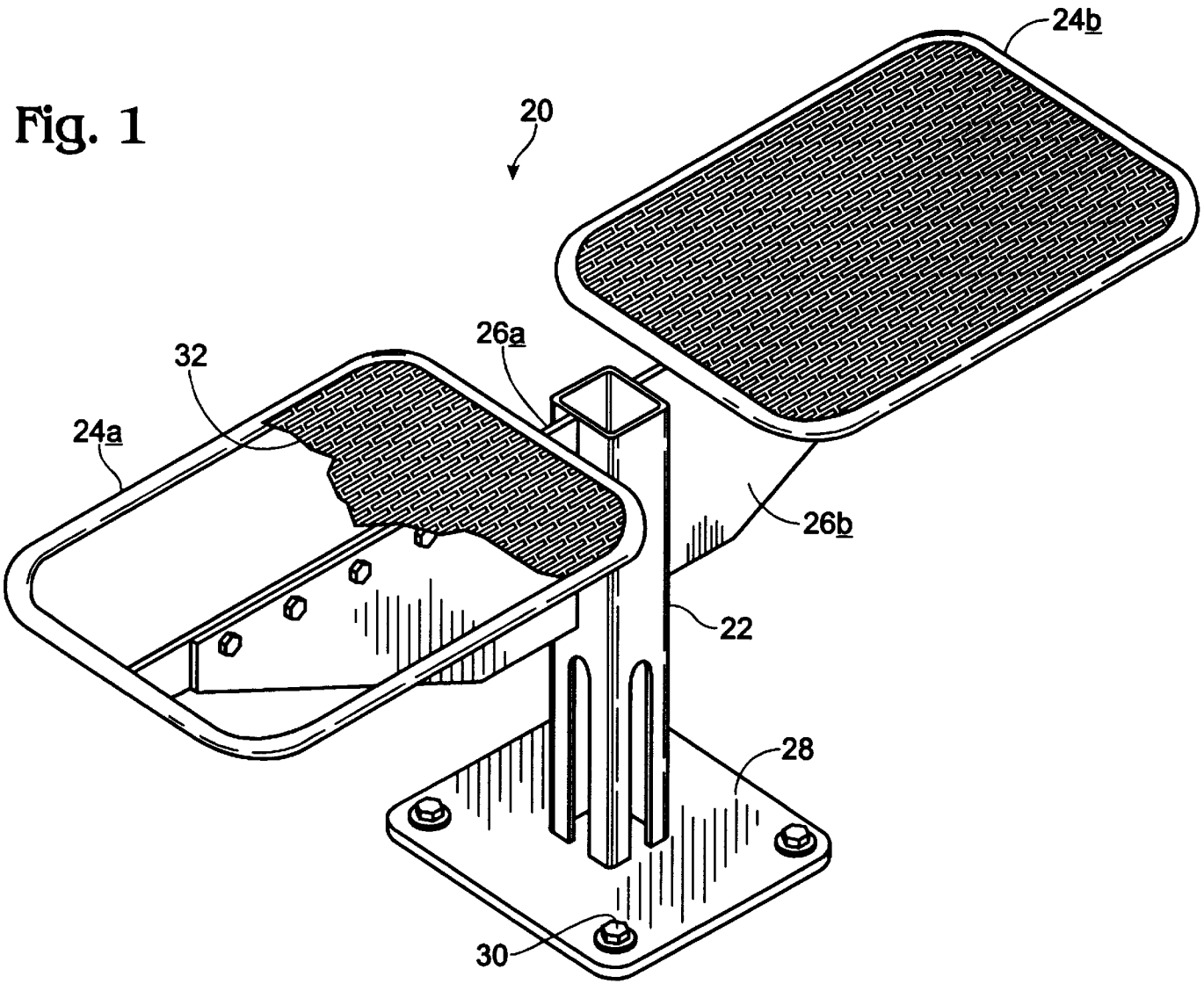
FIG. 1 is a perspective view of a bus stop seating device in accordance with a preferred embodiment of the invention.

FIG. 1 shows a preferred embodiment of a bus stop seating device in accordance with the present invention. Seating device 20 includes rigid tube 22, preferably made of steel. Tube 22 is dimensioned to encompass a bus stop sign pole (not shown). The cross-section of tube 22, in the preferred embodiment, is square, however, the tube could also have a circular cross-section.

Each of seating structures 24*a* and 24*b* is connected to tube 22 via support panels 26*a* and 26*b,* respectively. A metal plate 28 is connected to the bottom end of tube 22. Plate 28 is square and has holes and bolts 30 for fastening plate 28 to the ground.

Figure 2:
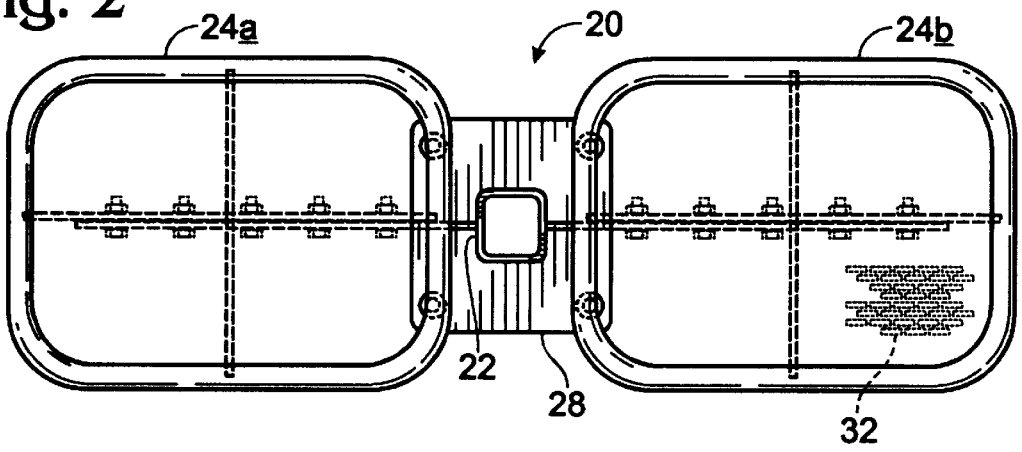
FIG. 2 is a top schematic view of the seating device shown in FIG. 1.

FIG. 2 shows a top view of seating device 20. The interior region of each seat structure 24*a* and 24*b* is preferably made of a porous material such as steel mesh 32 so that rain water does not accumulate or puddle on the seat.

Figure 3:
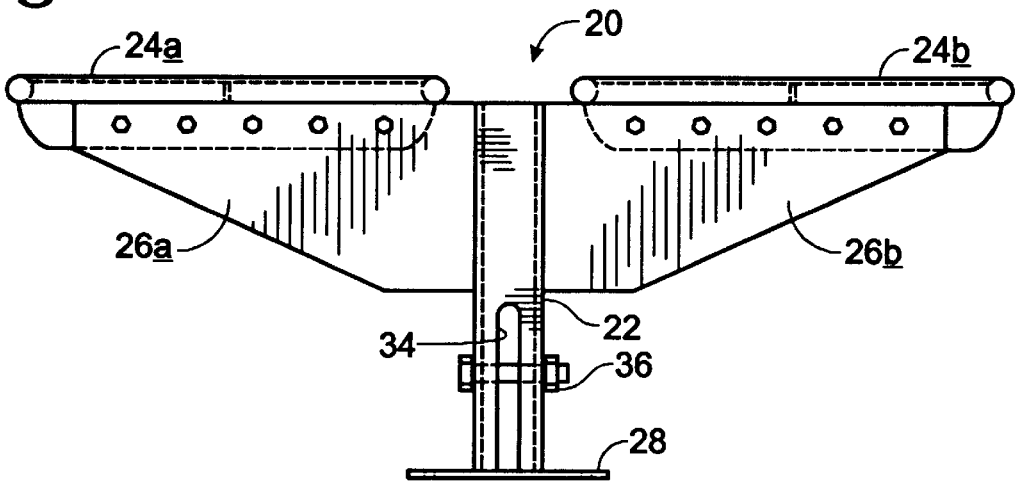
FIG. 3 is a front view of the preferred seating device.
Figure 4:
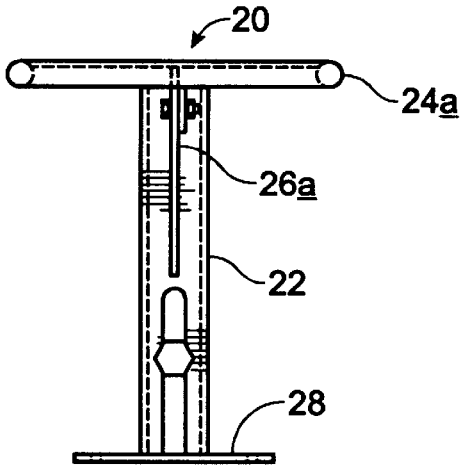
FIG. 4 is another side view of the seating device shown in FIG. 3.

FIG. 3 is a front view of the same seating device 20. Additionally, FIG. 3 shows elongate aperture 34 in tube 22. Tube 22 has similar apertures on the other three sides, two of which are illustrated in FIG. 1. Bolt 36 passes through opposing apertures, and may be used to secure seating device 20 to a sign post, for example, as illustrated in FIG. 7.

Figure 6:
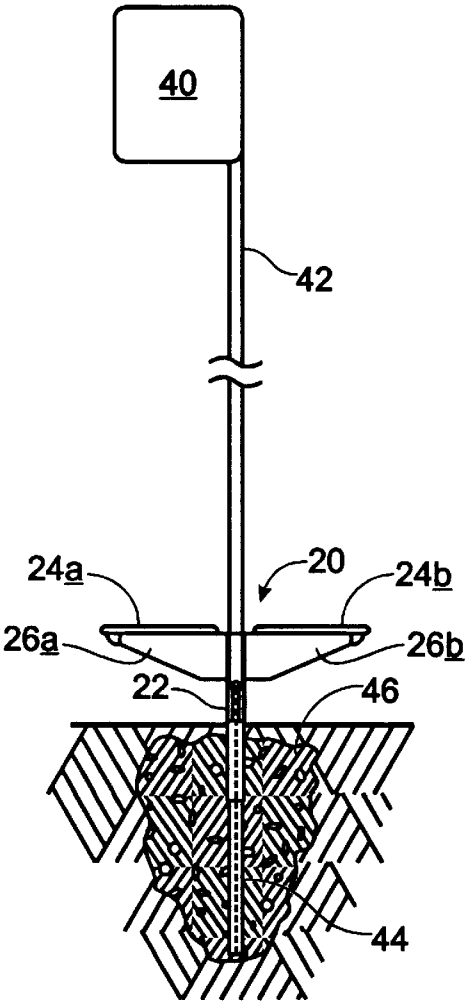
FIG. 6 is a cross-sectional side view of the sign post shown in FIG. 5, with the addition of a bus stop seating device mounted around the post.
Figure 5:
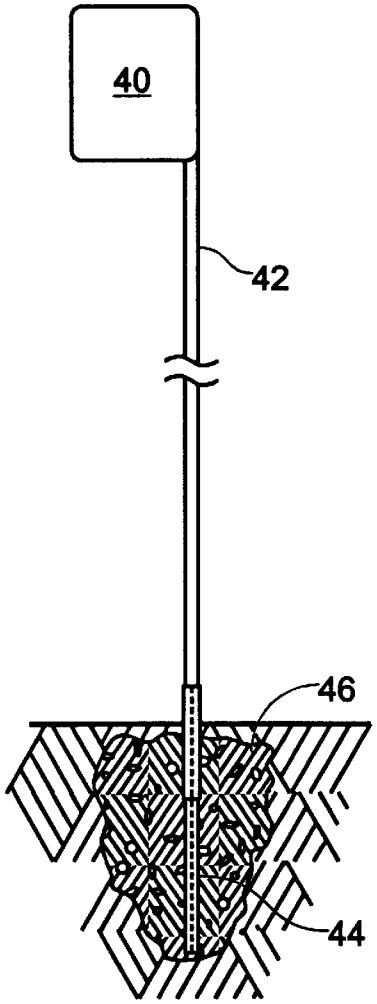
FIG. 5 is a cross-sectional side view of a sign post anchored in the ground.

FIG. 5 shows sign 40 attached to pole 42. Pole 42 has a lower portion 44 that is anchored in the ground by a concrete mass 46. The sign illustrated in FIG. 5 is shown in FIG. 6 with bus stop seating device 20. As shown, tube 22 encompasses sign post or pole 42.

Figure 7:
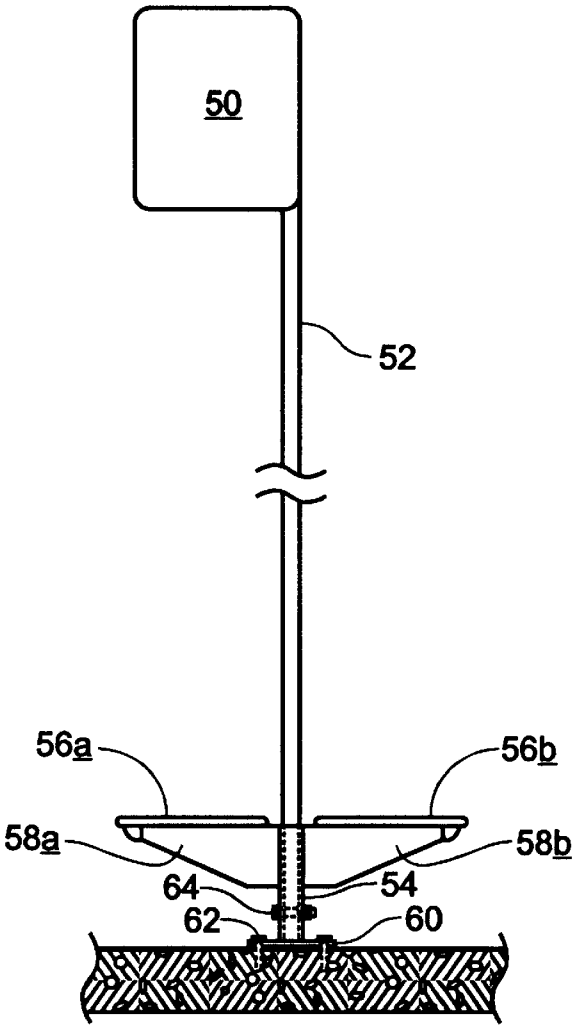
FIG. 7 is a cross-sectional side, partial view of a sign post and seating device in accordance with an alternate embodiment of the invention.

FIG. 7 shows an alternate embodiment of the present invention. Sign 50 is affixed to sign post 52. Post 52 is encompassed by rigid tube 54. Seat structures 56*a* and 56*b* are connected to tube 54 via rigid support panels 58*a* and 58*b,* respectively. Tube 54 is secured to post 52 by bolt 64. The entire assembly, including sign and seating structure, is anchored to the ground by bolts 62 through holes in metal plate 60. The assembly shown in FIG. 7 can be placed at a new location without creating a hole in pre-existing cement.

The bus stop seating assembly as described above has many important benefits and advantages. For example, the seating device provides bus stop seating in a limited amount of space. It allows passengers to be seated at a bus stop without interfering with the path of the bus. The sign-associated seats keep passengers off the curb. The invention minimizes the amount of concrete required to create a seat at a bus stop, while also minimizing the impact on adjacent business and property owners. The seats help to identify riders that are waiting for the bus. The seating device is simple in design, rugged and easy to maintain. The seating design can easily be adapted to serve and support passengers of all weights and sizes.

The seating device can be styled on an existing bus stop pole by either sliding the center tubular steel over the pole and anchoring the base plate with anchor bolts to existing concrete or pre-installed concrete footing. The bench may also be installed in a new location either utilizing existing concrete base or by constructing a new footing with anchor bolts and then sliding the pole into the tubular steel in the bus stop bench and securing the pole to the tube by through-bolts as previously described and illustrated.

Preferred dimensions of a bus stop seating device in accordance with the present invention are as follows. The space between seats 24*a* and 24*b* is approximately 5½-inches. Tube 22 is 3-inches by 3-inches. Plate 28 is 9-inches by 9-inches. Seat structure 24*a* is 14-inches by 20-inches. One-inch tubing circumscribes each of seat structures 24*a* and 24*b*. Slots, such as slot 34 in FIG. 3 are preferably 7-inches by 1-inch.

Specific preferred embodiments of the present invention have been described in detail above with reference to the drawings. However, many modifications of the invention are enabled and encompassed by the invention as claimed below.

I claim:

1. A seating device comprising a rigid tube having an inner diameter large enough to allow the tube to slide over a pre-existing sign post, a pair of rigid seat structures connected to the tube, defining two substantially coplanar seating surfaces that are approximately perpendicular to the tube and located on opposite sides of the tube, and an anchoring mechanism connected to a lower end of the tube for fastening the tube to the ground, wherein the anchoring mechanism and the seat structure are spaced from each other along the tube so that when the anchoring mechanism is fastened to the ground the seat structures are positioned at a level for people to sit.

2. The device of claim 1 wherein each seat structure is supported by a planar support member that is substantially perpendicular to the respective seat structure and generally parallel to the tube.

3. The device of claim 1 wherein the anchoring mechanism includes metal plate attached to the lower end of the tube, and bolts for connecting the plate to a concrete surface.

4. The device of claim 1 wherein the tube has a rectangular cross-section.

5. The device of claim 4 wherein the tube has a square cross-section.

6. The device of claim 1 wherein the tube has a circular cross-section.

7. The device of claim 1 wherein the seat structures have apertures so that rain does not pool on the seating surfaces.

8. A seating device comprising a sign including a post anchored in the ground, a rigid tube having an inner diameter large enough to allow the tube to slide over the sign post, a pair of rigid seat structures connected to the tube, defining two substantially coplanar seating surfaces that are approximately perpendicular to the tube and located on opposite sides of the tube, and an anchoring mechanism connected to a lower end of the tube for fastening the tube to the ground, wherein the anchoring mechanism and the seat structure are spaced from each other along the tube so that when the anchoring mechanism is fastened to the ground the seat structures are positioned at a level for people to sit.

9. The device of claim 8 wherein each seat structure is supported by a planar support member that is substantially perpendicular to the respective seat structure and generally parallel to the tube.

10. The device of claim 8 wherein the anchoring mechanism includes metal plate attached to the lower end of the tube, and bolts for connecting the plate to a concrete surface.

11. The device of claim 8 wherein the tube has a rectangular cross-section.

12. The device of claim 11 wherein the tube has a square cross-section.

13. The device of claim 8 wherein the tube has a circular cross-section.

14. The device of claim 8 wherein the seat structures have apertures so that rain does not pool on the seating surfaces.

* * * * *